US006527688B1

(12) United States Patent
Kucera et al.

(10) Patent No.: US 6,527,688 B1
(45) Date of Patent: Mar. 4, 2003

(54) APPLICATION OF PARTS TO MATERIAL

(75) Inventors: Mark Robert Kucera, Walled Lake, MI (US); Anthony John Lukasiewicz, Howell, MI (US); Lynn Anthony Tilley, Milford, MI (US)

(73) Assignee: Elopak Systems AG, Glattbrugg (CH)

( * ) Notice: Subject to any disclaimer, the term of this patent is extended or adjusted under 35 U.S.C. 154(b) by 0 days.

(21) Appl. No.: 09/529,928

(22) PCT Filed: Oct. 26, 1998

(86) PCT No.: PCT/GB98/03224

§ 371 (c)(1),
(2), (4) Date: Jul. 18, 2000

(87) PCT Pub. No.: WO99/29152

PCT Pub. Date: Jun. 17, 1999

Related U.S. Application Data

(60) Provisional application No. 60/063,096, filed on Oct. 24, 1997.

(51) Int. Cl.[7] ..... B31B 1/84

(52) U.S. Cl. ..... 493/87; 493/165; 53/133.2; 53/565

(58) Field of Search ..... 493/87, 165; 53/565, 53/133.2

(56) References Cited

U.S. PATENT DOCUMENTS

| | | | | |
|---|---|---|---|---|
| 4,548,021 | A | * | 10/1985 | Bader et al. |
| 4,566,250 | A | * | 1/1986 | Matsumura et al. |
| 5,247,778 | A | * | 9/1993 | Tisma |
| 5,473,857 | A | * | 12/1995 | Keeler |
| 5,484,374 | A | * | 1/1996 | Bachner et al. |
| 5,624,528 | A | * | 4/1997 | Abrams et al. |
| 5,819,504 | A | * | 10/1998 | Giacomelli et al. |
| 6,085,489 | A | * | 7/2000 | Bachner et al. |
| 6,321,813 | B1 | * | 11/2001 | Miyajima et al. |

* cited by examiner

*Primary Examiner*—Eugene Kim
(74) *Attorney, Agent, or Firm*—Reising, Ethington, Barnes, Kisselle, Learman & McCulloch, P.C.

(57) ABSTRACT

In an off-line, free standing, parts-orienting and feeding device, selected parts are fed by a hopper to and oriented in a centrifugal or vibratory parts feeder unit, and then discharged to a programmed transferring arrangement. The latter includes a slide shuttle unit for alternately receiving discharged parts in a plurality or passages and aligning the part receiving passages with one or more pressurized air passages to blow the parts through selected transfer tubes to pick and placement devices which serve to place the parts continually one at a time on packaging materials being processed on one or more packaging machines. Limit devices on each transfer tube signal the slide shuttle unit to realign the parts receiving passages with the pressurized air passages to provide parts as required by each machine.

13 Claims, 5 Drawing Sheets

APPLICATION OF PARTS TO MATERIAL

This application is a 371 of PCT/GB98/03224, filed Oct. 26, 1998 which claims benefit of U.S. Provisional Application Ser. No. 60/063/096, filed Oct. 24, 1997

This invention relates of application of parts to material and, more particularly, to a system wherein selected parts are hopper-fed to and oriented in an off-line parts feeder unit, and then fed from the unit to a mechanism for transfer to a machine for placement of the parts on material being processed on the machine.

In a case where small parts being handled are pour spout fitments for attaching to formed cartons, it is known to remove the fitments one-at-a-time from the exit end of a track and place each fitment through an opening in a top closure panel of a standing, open-topped carton, to be welded into place by an external ultrasonic welding horn. Such placement and welding units are shown and described in GB-A-2,238,287; U.S. Pat. No. 4,788,811; U.S. Pat. No. 4,386,923; U.S. Pat. No. 5,484,374; U.S. Pat. 5,267,934 and U.S. Pat. No. 5,435,803.

According to one aspect of the present invention, there is provided in combination, a machine including parts-applying means for applying parts to packaging material on said machine, a parts-supplying device including parts-supplying means, and transferring means extending from said device to said machine and serving to transfer said parts from said device to said machine, characterized in that said device is free-standing relative to said machine.

Owing to this aspect of the invention, it is possible to obtain greater flexibility in the relative positions of the machine and the parts-supplying device and to make the device more readily accessible and of greater capacity than if it were to be mounted at the top of the machine.

If desired, the device may be on the same level, i.e. the same floor, as the machine or may be at a higher or lower level than the machine, for example on a mezzanine floor above the machine.

According to a second aspect of the present invention, there is provided in combination, at least one machine including parts-applying means for applying parts to material on said machine(s), a parts-supplying device including parts-supplying means, and transferring means extending from said device to said machine(s) and serving to transfer said parts from said device to said machine(s), characterized in that the transferring means comprises a plurality of transfer tracks and said device further includes a discharge track for discharging said parts and a distributor arranged to receive said parts from said discharge track and to distribute them among said transfer tracks.

Owing to this aspect of the invention, it is possible for a single parts-supplying device to serve a plurality of parts applicators, whether on one-and-the-same machine, or on respective machines, or both.

According to a third aspect of the present invention, there is provided in combination, a machine including parts-applying means for applying parts to packaging material on said machine, a parts-supplying device including parts-supplying means, and transferring means extending from said device to said machine and serving to transfer said parts from said device to said machine, characterized in that said device has a clean-out track to serve in cleaning-out said parts from said device.

Owing to this aspect of the invention, it is possible to clean-out in an hygienic and automatic manner any parts remaining in the parts-supplying means when an emptying of the latter is desired.

In a preferred embodiment, a free-standing fitment sorting device supplies pour spout fitments to a form, fill and seal packaging machine from a remote, substantially ground level location. Plastics tubes, through which the pour spout fitments may be blown by compressed air, extend from the off-line sorting device to the packaging machine.

The device includes a parts handling bowl which, via centrifugal force created by rotary motion, urges the pour spout fitments toward and through suitable orienting devices to orient the fitments and feed them to a track for transfer to a slide shuttle assembly co-operable with programmable cylinder or servo-driven means for further transfer via the multiple plastics tubes to placement devices which assemble the fitments in any suitable manner onto one or more sets of dual in-line cartons being indexed along conveyors of the packaging machine.

In order that the invention may be clearly and completely disclosed, reference will now be made, by way of example, to the accompanying drawings, in which:FIG.

Figure 1:
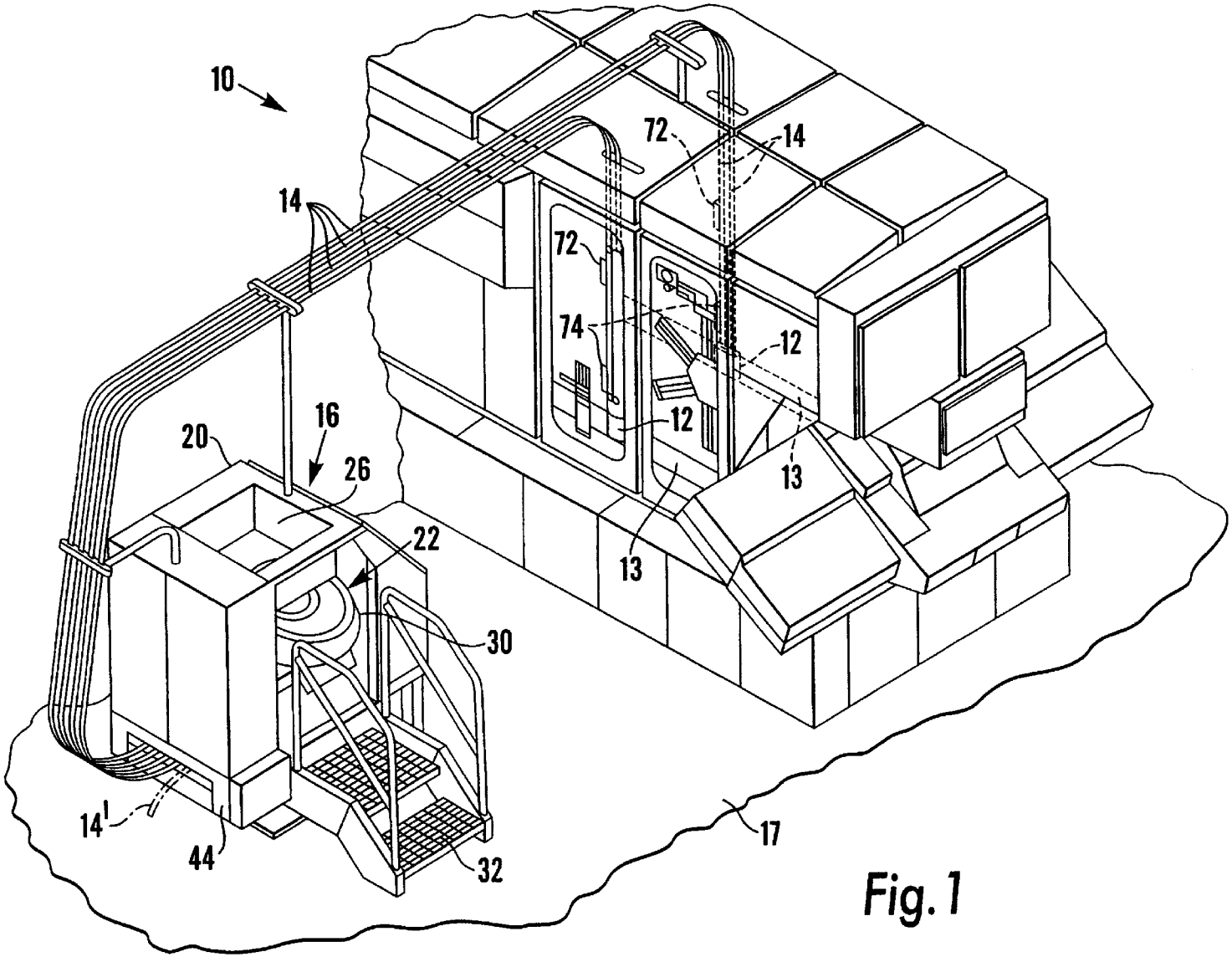
FIG. 1 is a perspective view of a form, fill and seal packaging machine and an associated off-line orienting and feeding device.
Figure 7:
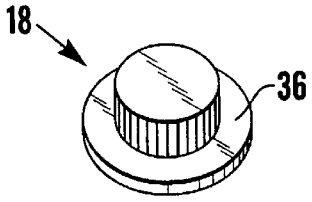
FIG. 7 is a perspective view of a part which may be handled by the device.
Figure 8:
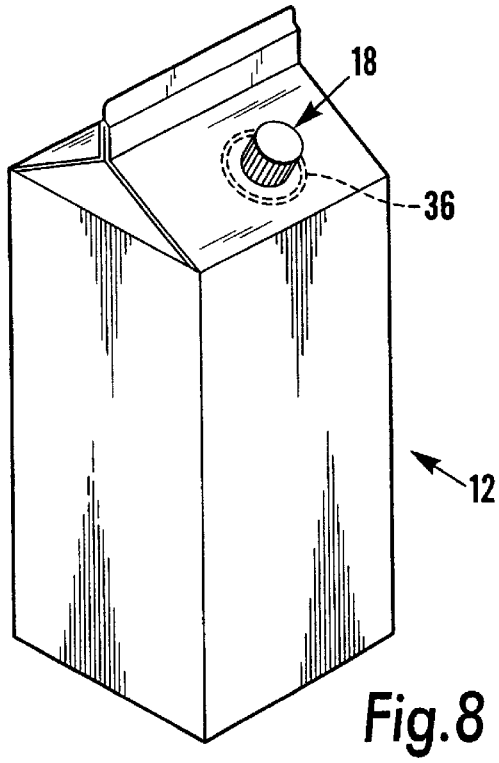
FIG. 8 is a perspective view of a liquid packaging carton with that part in place thereon.

Referring now to the drawings in greater detail, FIG. 1 illustrates a form, fill and seal packaging machine 10 which processes cartons, represented at 12 and shown more clearly in FIG. 8. The cartons 12 are advanced through the machine in one row, or (as shown) a plurality of parallel rows, by one or more horizontal conveyors 13. A plurality of plastics tubes 14 extend to the machine 10 from an off-line orienting and feeding device 16. The machine 10 and the device 16 stand upon a floor 17 and are horizontally spaced apart. The device 16 serves to process parts in the form of identical pour spout fitments 18, of which one is shown in FIG. 7.

Figure 2:
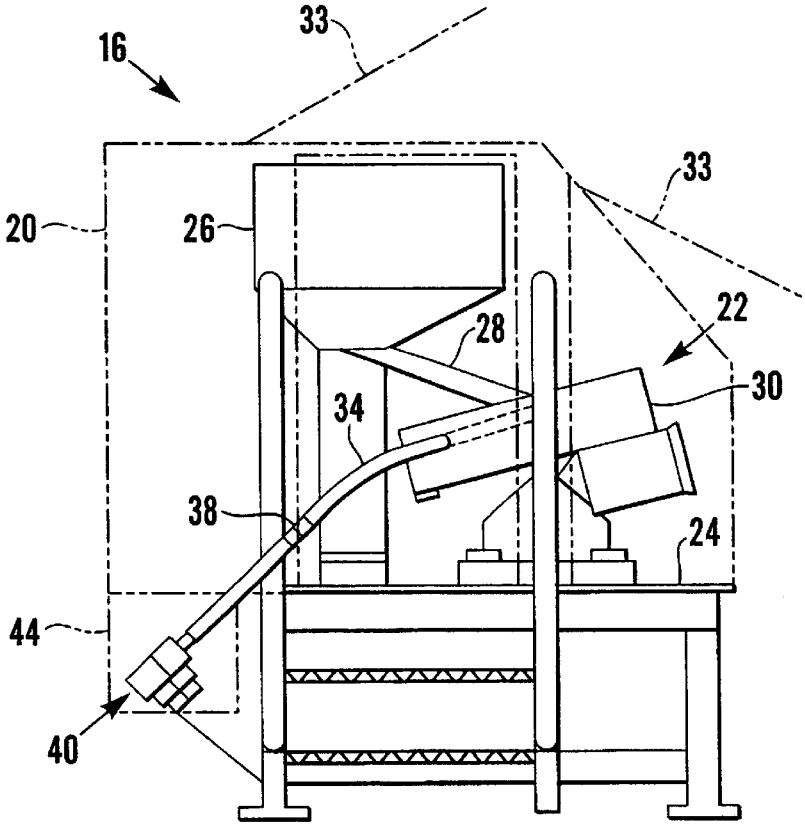
FIG. 2 is a side elevation of the off-line orienting and feeding device.

The device 16 (FIGS. 1 to 3) includes a housing 20, enclosing a parts feeder unit 22 mounted on a stand 24 (FIG. 2). A hopper 26 is mounted on the stand 24 so as to be located above the parts feeder unit 22, and is adapted to supply the fitments 18 via a connector member 28 to a bowl 30 of the parts feeder unit 22. Steps 32 (or alternate steps 32') at a side of the housing 20, permit an operator to fill the hopper 26 with parts, as needed, completely remote from the operating packaging machine 10. Although steps 32 or 32' are shown, it is much preferred that the operator should be able to fill the hopper 26 from ground level. Covers, represented as 33 (FIG. 2), may be pivotally mounted over the hopper 26 and the bowl 30.

A track 34 (FIG. 2) angles downwardly from the discharge end of the bowl 30. The bowl 30 is powered by any suitable means, causing the fitments 18 to project outwardly to encounter tracks, guide devices, rails, twists, cut-outs, air jets, or other elements (not shown) as required to cause each fitment 18 to be oriented, for example, by hanging by its flange 36 on rails, or, if incorrectly positioned, to be dropped or blown back into the bowl to be caused to return in another pass. The bowl 30 is preferably a bowl of a centrifugal parts feeder well known per se, which, via centrifugal force created by rotary motion, urges the parts 18 towards and through orienting devices to orient the parts. Alternately, the bowl 30 may be a bowl of a vibratory parts feeder well known per se, which causes the parts to travel, in response to vibration, around an upwardly spiralling track secured to the inside surface of the bowl wall, to become oriented while travelling past elements mounted along the track.

Figure 4:
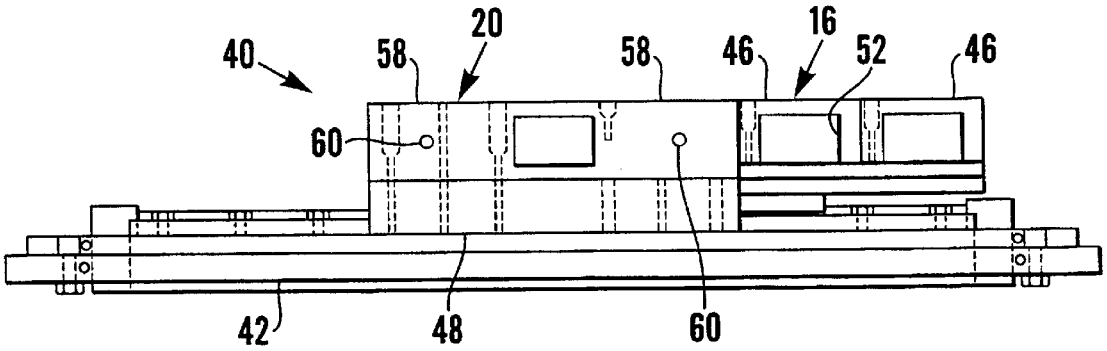
FIG. 4 is a side elevation of a shuttle assembly of the device.
Figure 5:
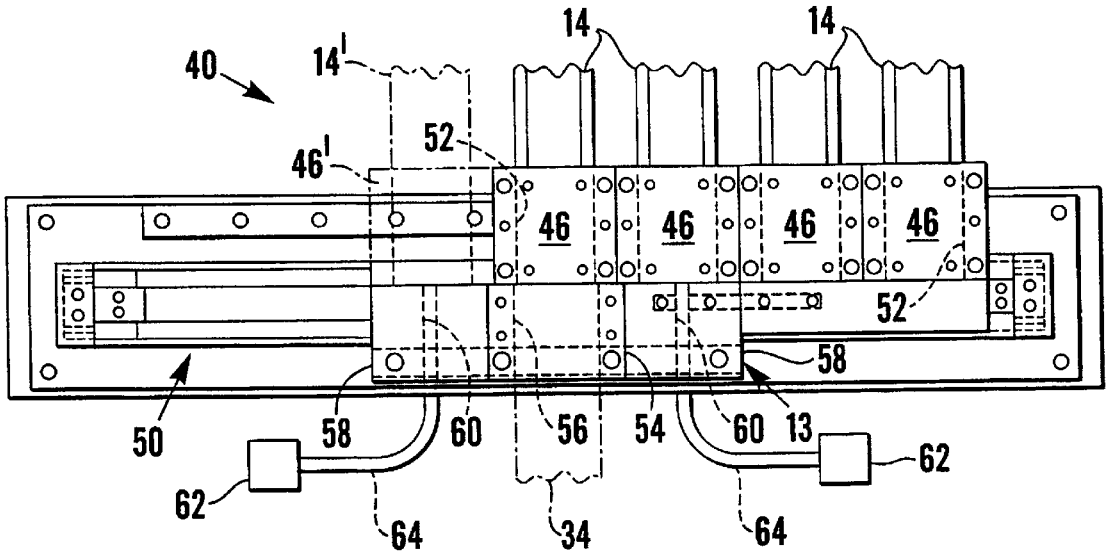
FIG. 5 is a top plan view of the shuttle assembly.
Figure 6:
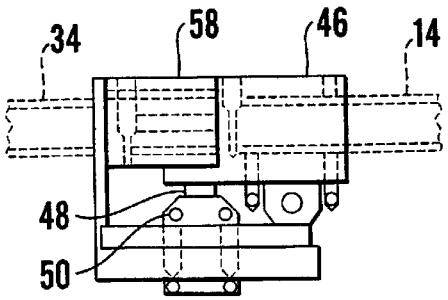
FIG. 6 is an end elevation of the shuttle assembly.

An air cylinder 38 (FIG. 2) is mounted at an intermediate location along the track 34, for a purpose to be described. A slide shuttle assembly 40 (FIG. 2) is positioned adjacent the exit end of the track 34. As shown in FIGS. 4 to 6, the slide-shuttle assembly 40 includes a base 42 fixedly mounted in a portion 44 (FIG. 2) of the housing 20. A plurality (four are shown) of track mounting blocks 46 are mounted in this case on a piston portion 48 of a suitable programmable air cylinder 50 (FIG. 5). Each mounting block 46 has an end portion of one of the interconnecting plastic tubes 14 secured in a passage 52 formed through the block. The mounting blocks 46 are interconnected to move as a unit with the piston portion 48.

A fixed mounting block 54 (FIG. 5) is secured to the base 42, and includes a passage 56 formed therethrough for receiving and confining the end portion of the fixed track 34. A pair of air manifold blocks 58 are secured to the base 42 on opposite sides of the fixed mounting block 54 and abut against the oppositely disposed side walls of the block 54. An air passage 60 is formed through the centre of each block 58, parallel to the track mounting passage 56 in the block 54. A source 62 of compressed air is connected by a line 64 to each air passage 60. Suitable valves are included in an air valve pack 66 (FIG. 3) mounted in the housing 20.

Figure 3:
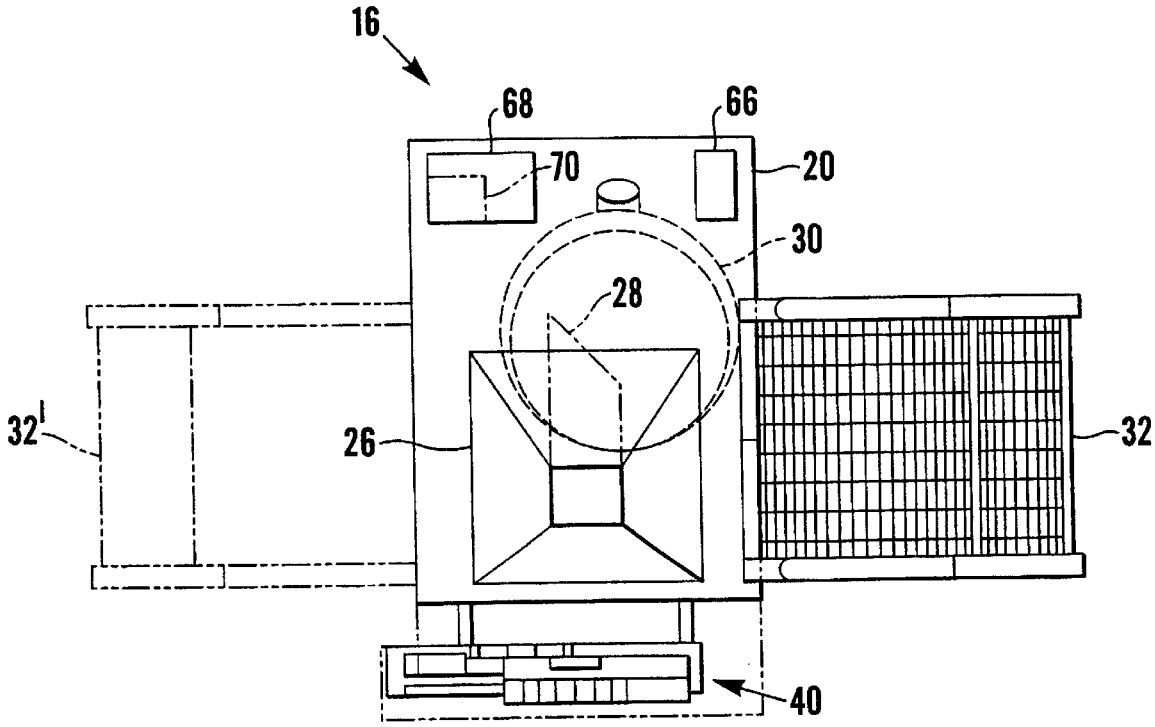
FIG. 3 is a top plan view of the device.

As shown in FIG. 3, a terminal box 68 including required relays and a controller, represented at 70, may be mounted in the housing 20, operatively connected to the programmable air cylinder 50.

A suitable fitment-detector, for example a limit switch or a photoelectric arrangement represented at 72 in FIG. 1, is operatively connected to each tube 14 at a predetermined point along the height thereof within the form, fill and seal packaging machine 10. The photoelectric unit 72 causes an escapement or pick-and-placement unit, represented at 74 and as shown and described in, for example, EP-A-0819611, to be supplied with fitments 18, as required.

As illustrated in dot-dash lines in FIGS. 1 and 5, there may be a short tube 14' to discharge at a selected location between the device 16 and the machine 10 to serve as a clean-out chute to facilitate emptying the hopper 26 and the bowl 30 for a colour and/or product change. The tube 14' would be connected to a further mounting block 46' fixed to the blocks 46 and thus able to be brought into and out of alignment with the block 54 and one of the air passages 60.

In operation, the fitments 18 are supplied from the hopper 26 (FIG. 2) to the bowl 30, where the fitments are oriented and discharged into the inlet of the track 34. As such, fitments 18 are aligned at all times in the track 34 down to the air cylinder 38.

Referring particularly to FIG. 5, upon the release of fitments 18 by the air cylinder 38, the respective fitments exit from the end of the track 34, through the adjacent passage 52 of an aligned mounting block 46 into its plastic tube 14. As called for by the respective photoelectric units 72 (FIG. 1) at the other end of the tubes 14, the mounting blocks 46 and their associated tube end portions are caused by the signal to and from the controller 70 (FIG. 3) to move to the left in FIG. 5, so that the particular mounting block in question becomes aligned with the left-hand air passage 60. In this position, a blast of air through the passage 60 from the source 62 of compressed air sends the fitments 18 now in the adjacent tube 14, firstly downwardly to exit from the housing 20 (FIG. 1), then upwardly, across the horizontal gap between the device 16 and the machine 10 at a level above the device and the machine and above any pedestrian or vehicular traffic along the gap, and down the tube past the photoelectric unit 72. Each photo-electric unit 72 includes a delay whereby parts falling past the unit do not actuate it. However, once the fitments 18 are filled to the point of stopping adjacent the unit 72, a signal therefrom stops the blowing of fitments through its particular tube 14. Then, when the line-up of fitments, which may extend well above the unit 72, drops below the unit 72 owing to the consumption thereof by the unit 74, the unit 72 signals for another batch of fitments to be released by the air cylinder 38 into the associated mounting block 46 and tube 14 moved by the programmable air cylinder 50 into alignment with one of the air passages 60. In lieu of a single delay-type photoelectric unit 72, a pair of upper and lower photoelectric units or limit switches could be used.

As may be visualized from FIG. 5, the two left-hand mounting blocks 46 are moved by the programmable air cylinder 50 to the left-hand block 58, and the two right-hand mounting blocks 46 are moved by the air cylinder 50 to right-hand block 58. This has the advantage that the mounting blocks travel less distance than if there were to be only one air passage 60, and thus permits a relative increase in the output rate of the device 16.

As any of the photoelectric units 72 calls for fitments 18, the signal to the controller 70 results in signals sent to the programmable air cylinder 50 to move the mounting blocks 46 to align the correct tube 14 with the fixed block 54, and to the air cylinder 38 on the fixed track 34 to release fitments 18 thereto, and then to move to the left-hand or right-hand block 58 to be blown through the tube 14 to stack up adjacent and above the specific photoelectric unit.

Figure 9:
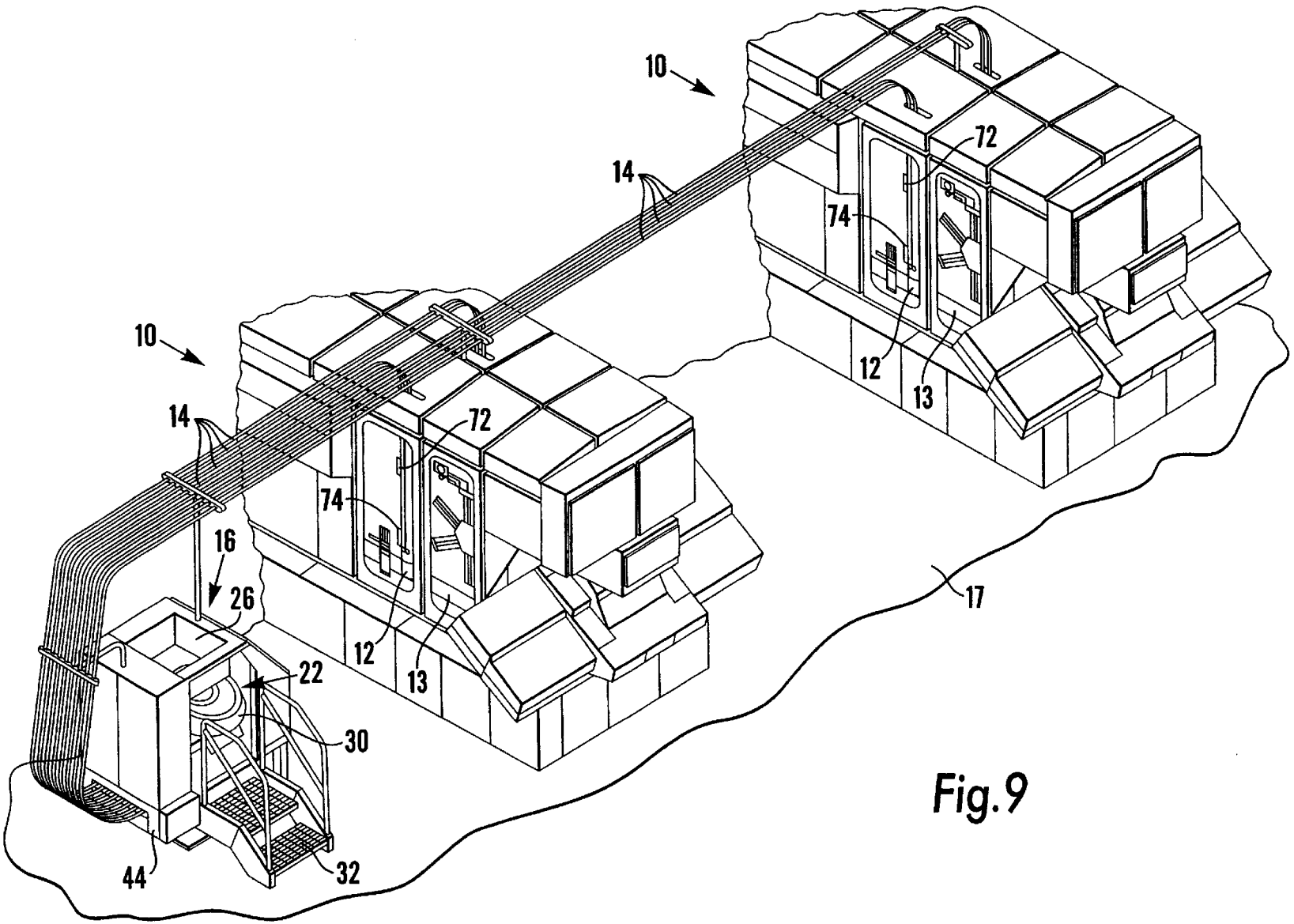
FIG. 9 is a perspective view of a plurality of form, fill and seal packaging machines and an associated off-line orienting and feeding device.

If desired, and as shown in FIG. 9, a single, free-standing device 16 may supply a plurality of machines 10 which may be horizontally spaced not only from the device 16 but also from each other.

It should be apparent that the off-line orienting and feeding device is practical as a free-standing sorting unit that supplies parts to one or more processing machines, with an operator being free, for example, to load the hopper or remove faulty parts from the device, at substantially ground level, without having to climb around an operating processing machine.

It should be further apparent that the off-line orienting and feeding device may handle substantially any kind of small parts, and feed them to any suitable placement device on a processing machine performing various kinds of assembly.

It should also be apparent that the enclosed tubes and compressed air blowing arrangement serve as an efficient means of transferring the small parts across convenient distances to the processing machine, without jamming or disruption therealong.

It should also be evident that any number of mounting blocks and associated tubes, instead of the four shown, may be used, depending upon the application involved. In any case, one of the tubes may be short to serve as a clean-out chute to facilitate emptying the hopper for a colour and/or product change. In addition, the plastics tubes may be directed to spaced-apart processing machines, as in FIG. 9 for example, rather than to the two-line machine shown in FIG. 1. Moreover, to reduce the number of long tubes used, it is possible to employ diverters in the long tubes to switch the flow of parts into short tubes leading to the or each intermediate machine 10.

It would also be possible to utilize a vacuum system in lieu of the compressed air system described.

Additionally, a high efficiency particulate air (hepa) system could be installed in order to supply clean air to the device 16, thereby protecting the pour spout fitments from any contamination present in the production environment.

What is claimed is:

1. In combination, a machine including first and second parts-applying devices for applying respective series of parts to packaging material on said machine, a pressure-differential-producing means, a parts-supplying device including parts-supplying means and free-standing relative to said machine, and transferring means extending from said parts-supplying device to the first and second parts-applying devices of said machine and serving to transfer said parts from said parts-supplying device to the first and second parts-applying devices of said machine, said transferring means comprising first and second pneumatic transferring means by way of which the respective first and second parts-applying devices are supplied with said respective series of parts, and said first and second pneumatic transferring means comprising respective first and second transfer tracks communicable with said pressure-differential-producing means to produce respective gas pressure differentials in said first and second transfer tracks to displace said respective series of parts along said respective first and second transfer tracks.

2. A combination according to claim 1, wherein the machine comprises a plurality of conveying means arranged to advance respective packaging materials and wherein the first and second parts-applying means comprise respective parts applicators associated with the respective conveying means of the machine.

3. A combination according to claim 1, wherein said parts-supplying device further includes a discharge track for discharging oriented parts and a distributor arranged to receive oriented parts from said discharge track and to distribute them among said transfer tracks.

4. A combination according to claim 3, wherein said distributor comprises a slide shuttle.

5. A combination according to claim 1, wherein said parts supplying device further comprises a clean-out track to serve in cleaning out said parts from said device.

6. In combination first and second machines including respective first and second parts-applying devices for applying respective series of parts to packaging materials on the respective first and second machines, a pressure-differential-producing means, a parts-supplying device including parts-supplying means and free-standing relative to said first and second machines, and transferring means extending from said parts-supplying device to the first and second parts-applying devices of the respective first and second machines and serving to transfer said parts from said parts-supplying device to the first and second parts-applying devices of the respective first and second machines, said transferring means comprising first and second pneumatic transferring means by way of which the respective first and second parts-applying devices are supplied with said respective series of parts, and said first and second pneumatic transferring means comprising respective first and second transfer tracks communicable with said pressure-differential-producing means to produce respective gas pressure differentials in said first and second transfer tracks to displace said respective series of parts along said respective first and second transfer tracks.

7. A combination according to claim 6, wherein said first and second machines comprise respective first and second conveying means arranged to advance the respective packaging materials and wherein the first and second parts-applying devices comprise respective first and second parts applicators associated with the respective first and second conveying means.

8. A combination according to claim 6, wherein the said parts-supplying device further includes a discharge track for discharging oriented parts and a distributor arranged to receive oriented parts from said discharge track and th distribute them among said transfer tracks.

9. A combination according to claim 8, wherein said distributor comprises a slide shuttle.

10. A combination according to claim 6, wherein said parts-supplying device further comprises a clean-out track to serve in cleaning-out said parts from said device.

11. In combination, a machine including parts-applying means for applying parts to packaging material on said machine, a pressure-differential-producing means, a parts-supplying device including parts-supplying means and free-standing relative to said machine, and transferring means extending from said device to said machine and serving to transfer said parts from said device to said machine, said transferring means comprising pneumatic transferring means, said pneumatic transferring means comprising a transfer track communicable with said pressure-differential-producing means to produce a gas pressure differential in said track to displace said parts along said track, said transferring means comprising a plurality of transfer tracks; and said device further including a discharge track for discharging oriented parts and a distributor comprised of fixed passage means and of a slide shuttle and arranged to receive oriented parts from said discharge track and to distribute them among said transfer tracks, said pressure-differential-producing means comprising a source of compressed gas for supplying said compressed gas to said passage means which at times directs said gas into selected ones of said transfer tracks, and said distributor further comprising retention means attaching said transfer tracks to said slide shuttle, and programmed drive means for laterally moving said slide shuttle and thereby bringing entry ends of said transfer tracks selectively into and out of alignment with said passage means to cause parts to be blown through said transfer tracks by said compressed gas to the parts-applying means.

12. A combination according to claim 11, wherein said fixed passage means comprises a plurality of fixed passages and wherein a plurality of said transfer tracks and said retention means are selectively alternatively moved by said programmed drive means into alignment with each of said fixed passages.

13. A combination according to claim 11 and further comprising parts detecting means at the respective transfer tracks at the or each machine and arranged to signal said programmed drive means when any of respective portions of the transfer tracks at the machine are full of parts.

* * * * *